US010156163B2

(12) United States Patent
Stucchi et al.

(10) Patent No.: US 10,156,163 B2
(45) **Date of Patent: *Dec. 18, 2018**

(54) SYSTEM AND METHOD FOR VARIABLE ACTUATION OF A VALVE OF AN INTERNAL-COMBUSTION ENGINE, WITH A DEVICE FOR DAMPENING PRESSURE OSCILLATIONS

(71) Applicant: C.R.F. Società Consortile per Azioni, Orbassano (Turin) (IT)

(72) Inventors: Sergio Stucchi, Valenzano (IT); Raffaele Ricco, Casamassima (IT); Marcello Gargano, Torre a Mare (IT); Onofrio De Michele, Castellana Grotte (IT); Carlo Mazzarella, Noicattaro (IT)

(73) Assignee: C.R.F. SOCIETA CONSORTILE PER AZIONI, Orbassano (Turin) (IT)

( * ) Notice: Subject to any disclaimer, the term of this patent is extended or adjusted under 35 U.S.C. 154(b) by 140 days.

This patent is subject to a terminal disclaimer.

(21) Appl. No.: 15/280,577

(22) Filed: Sep. 29, 2016

(65) Prior Publication Data

US 2017/0101903 A1 Apr. 13, 2017

(30) Foreign Application Priority Data

Oct. 13, 2015 (EP) ..... 15189506

(51) Int. Cl.
*F01L 1/25* (2006.01)
*F02D 13/02* (2006.01)
(Continued)

(52) U.S. Cl.
CPC ..... *F01L 1/25* (2013.01); *F01L 9/025* (2013.01); *F02D 13/0207* (2013.01);
(Continued)

(58) Field of Classification Search
CPC ..... F01L 1/25; F02D 13/0207
(Continued)

(56) References Cited

U.S. PATENT DOCUMENTS 4,671,221 A * 6/1987 Geringer ..... F01L 1/25 123/198 F
5,127,375 A * 7/1992 Bowman ..... F01L 9/023 123/90.12
(Continued)

FOREIGN PATENT DOCUMENTS

DE 2926327 A1 1/1981
DE 3625664 A1 2/1988
(Continued)

OTHER PUBLICATIONS

Corresponding European Search Report for EP application No. 15189506, completed on Mar. 17, 2016, and dated Mar. 24, 2016.

*Primary Examiner* — Jason Newton
(74) *Attorney, Agent, or Firm* — Victor Cardona; Heslin Rothenberg Farley & Mesiti P.C.

(57) ABSTRACT

A system for variable actuation of an engine valve of an internal-combustion engine includes a master piston and a slave piston, driven by the master piston. A control valve controls a communication of a volume of a pressurized fluid with a lower pressure environment, which is connected to a fluid accumulator, and an electronic control unit controls the electrically operated control valve. A device for dampening pressure oscillations is connected to the volume of pressurized fluid and includes an additional volume adapted for receiving fluid from the volume of pressurized fluid only when, following upon oscillations of the pressure in the volume of pressurized fluid, the pressure exceeds a maximum threshold value, which is higher than a mean pressure value that is set up in the volume of pressurized fluid when
(Continued)

the master piston drives the slave piston in normal operating conditions.

17 Claims, 13 Drawing Sheets

(51) Int. Cl.
*F01L 9/02* (2006.01)
*F01L 1/053* (2006.01)

(52) U.S. Cl.
CPC ... *F01L 2001/0537* (2013.01); *F01L 2810/03* (2013.01); *F01L 2810/04* (2013.01)

(58) Field of Classification Search
USPC ..... 123/90.12
See application file for complete search history.

(56) References Cited

U.S. PATENT DOCUMENTS

| | | | | | |
|---|---|---|---|---|---|
| 5,680,841 | A * | 10/1997 | Hu | F01L 1/181 | 123/321 |
| 6,530,350 | B2 * | 3/2003 | Chiappini | F01L 9/021 | 123/198 F |
| 6,655,349 | B1 * | 12/2003 | Cavanagh | F01L 1/181 | 123/321 |
| 9,279,350 | B2 * | 3/2016 | Yeager | F01L 1/24 | |
| 9,957,856 | B2 * | 5/2018 | Beier | F01L 9/025 | |
| 2007/0204818 | A1 * | 9/2007 | Dingle | F01L 1/181 | 123/90.16 |
| 2017/0101903 | A1 * | 4/2017 | Stucchi | F01L 1/25 | |
| 2017/0175592 | A1 * | 6/2017 | Stucchi | F01L 1/047 | |

FOREIGN PATENT DOCUMENTS

| | | | | |
|---|---|---|---|---|
| DE | 102005000621 | A1 * | 7/2006 | F01L 9/025 |
| EP | 0498682 | A1 | 1/1992 | |
| EP | 0803642 | B1 | 11/2000 | |
| EP | 1091097 | A1 | 4/2001 | |
| EP | 1243761 | A1 | 9/2002 | |
| EP | 1344900 | A2 | 9/2003 | |
| EP | 1508676 | A2 | 2/2005 | |
| EP | 1555398 | A1 | 7/2005 | |
| EP | 1674673 | A1 | 6/2006 | |
| EP | 1726790 | A1 | 11/2006 | |
| EP | 2597276 | A1 | 5/2013 | |
| EP | 2806195 | A1 | 11/2014 | |
| GB | 2070716 | A1 | 9/1981 | |

* cited by examiner

Prior art

Prior art

Prior art

SYSTEM AND METHOD FOR VARIABLE ACTUATION OF A VALVE OF AN INTERNAL-COMBUSTION ENGINE, WITH A DEVICE FOR DAMPENING PRESSURE OSCILLATIONS

CROSS REFERENCE TO RELATED APPLICATIONS

This application claims priority from European patent application No. 15189506.7 filed on Oct. 13, 2015, the entire disclosure of which is incorporated herein by reference.

FIELD OF THE INVENTION

The present invention relates to systems for variable actuation of engine valves for internal-combustion engines, of the type comprising:

a master piston driven directly or indirectly by a cam of a camshaft of the internal-combustion engine;

a slave piston, which drives said engine valve and is hydraulically driven by said master piston, by means of a volume of pressurized fluid interposed between the master piston and the slave piston;

an electrically operated control valve, which controls a communication of said volume of pressurized fluid with a lower pressure environment, said lower pressure environment being connected to a fluid accumulator; and an electronic control unit for controlling said electrically operated control valve on the basis of one or more parameters indicating the operating conditions of the engine and/or of the system for variable actuation of the engine valves.

PRIOR ART

Since long, the present applicant has been developing internal-combustion engines provided with a system of the above indicated type, for variable actuation of the intake valves, marketed under the trademark "Multiair", this system having the features referred to above. The present applicant is the assignee of many patents and patent applications relating to engines provided with a system of this type and to components of this system.

FIG. 1 of the annexed drawings shows a cross-sectional view of a cylinder head of an internal-combustion engine according to the technique described in EP 0 803 642 B1. The cylinder head illustrated in FIG. 1 and designated by the reference number 1 is applied to an engine with four cylinders in line; however, the variable-actuation system illustrated therein is of general application. The cylinder head 1 comprises, for each cylinder, a cavity 2, which is formed in the base surface 3 of the cylinder head 1 and defines the combustion chamber. Giving out into the cavity 2 are two intake ducts 4, 5 (the duct 5 is represented with a dashed line) and two exhaust ducts 6 (only one of which is visible in the figure). Communication of the two intake ducts 4, 5 with the combustion chamber 2 is controlled by two intake valves 7 (only one of which is visible in the figure), of the traditional poppet type, each comprising a stem 8 slidably mounted in the body of the cylinder head 1.

Each valve 7 is recalled into the closing position by springs 9 interposed between an internal surface of the cylinder head 1 and an end valve retainer 10. Communication of the two exhaust ducts 6 with the combustion chamber is controlled by two valves 70 (only one of which is visible in the figure), which are also of a conventional type and associated to which are springs 9 for return towards the closed position.

Opening of each intake valve 7 is controlled, in the way that will be described in what follows, by a camshaft 11, which is rotatably mounted about an axis 12 within supports of the cylinder head 1 and comprises a plurality of cams 14 for actuation of the intake valves 7 of the internal-combustion engine.

Each cam 14 that controls an intake valve 7 co-operates with the plate 15 of a tappet 16 slidably mounted along an axis 17, which, in the case of the example illustrated in the prior document cited, is set substantially at 90° with respect to the axis of the valve 7. The plate 15 is recalled against the cam 14 by a spring associated thereto. The tappet 16 constitutes a pumping plunger, or master piston, slidably mounted within a bushing 18 carried by a body 19 of a pre-assembled unit 20, which incorporates all the electrical and hydraulic devices associated to actuation of the intake valves, according to what is described in detail in what follows. There may be provided a separate unit 20 for each cylinder of the engine.

The master piston 16 is able to transmit a force to the stem 8 of the valve 7 so as to cause opening of the latter against the action of the elastic means 9, by means of pressurized fluid (preferably oil coming from the engine-lubrication circuit) present in a volume of pressurized fluid C facing which is the master piston 16, and by means of a slave piston 21 slidably mounted in a cylindrical body constituted by a bushing 22, which is also carried by the body 19 of the pre-assembled unit 20.

Once again with reference to FIG. 1, the volume of pressurized fluid C associated to each intake valve 7 can be set in communication with a lower pressure environment, constituted by an exhaust channel 23, via a solenoid valve 24. The channel 23 is designed to receive from the engine-lubrication circuit oil supplied by the pump of the lubrication circuit, via a duct arranged in which are one or more bleeding siphons and a non-return valve (see in this connection, for example, EP-A-1 243 761 and EP-A-1 555 398 in the name of the present applicant).

The solenoid valve 24, which may be of any known type suitable for the purpose illustrated herein, is controlled by electronic control means 25, as a function of signals S indicating operating parameters of the engine, such as the position of the accelerator and the engine r.p.m. or the temperature or viscosity of the oil in the system for variable actuation of the valves.

When the solenoid of the solenoid valve 24 is energized, the solenoid valve is closed so as to maintain the volume of fluid C under pressure and enable actuation of each intake valve 7 by the respective cam 14, via the master piston 16, the slave piston 21, and the volume of oil comprised between them.

When the solenoid of the solenoid valve 24 is de-energized, the solenoid valve opens so that the volume C enters into communication with the channel 23, and the pressurized fluid present in the volume C flows into this channel. Consequently, a decoupling is obtained of the cam 14 and of the master piston 16 from the intake valve 7, which thus returns rapidly into its closing position under the action of the return springs 9.

By controlling the communication between the volume C and the exhaust channel 23, it is consequently possible to vary the timing of opening and/or closing and the opening lift of each intake valve 7.

The exhaust channels 23 of the various solenoid valves 24 all give out into one and the same longitudinal channel 26 communicating with pressure accumulators 27, only one of which is visible in FIG. 1. Each accumulator is substantially constituted by a cylindrical body in which a plunger is slidably mounted, defining an accumulator chamber, which communicates with the low-pressure environment defined by the exhaust channels 23, 26. A helical spring within the accumulator recalls the plunger of the accumulator into a position in which the volume for receiving the fluid within the accumulator is minimum. When the solenoid valve 24 is opened, part of the pressurized fluid coming from the volume C flows into the accumulator 270.

The master piston 16 with the associated bushing 18, the slave piston 21 with the associated bushing 22, the solenoid valve 24, and the channels 23, 26 are carried by, or formed in, the aforesaid body 19 of the pre-assembled unit 20, to the advantage of rapidity and ease of assembly of the engine.

In the example illustrated, the exhaust valves 70 associated to each cylinder are controlled in a conventional way, by a respective camshaft 28, via respective tappets 29, even though in principle there is not excluded application of the variable-actuation system also to the exhaust valves. This applies also to the present invention.

Once again with reference to FIG. 1, the variable-volume chamber defined inside the bushing 22 and facing the slave piston 21 (which in FIG. 1 is illustrated in its condition of minimum volume, given that the slave piston 21 is at its top dead centre) communicates with the pressurized-fluid chamber C via an opening 30 made in an end wall of the bushing 22. This opening 30 is engaged by an end nose 31 of the plunger 21 in such a way as to provide hydraulic braking of the movement of the valve 7 in the closing phase, when the valve is close to the closing position, in so far as the oil present in the variable-volume chamber is forced to flow into the volume of pressurized fluid C passing through the clearance existing between the end nose 31 and the wall of the opening 30 engaged thereby. In addition to the communication constituted by the opening 30, the volume of pressurized fluid C and the variable-volume chamber of the slave piston 21 communicate with one another via internal passages made in the body of the slave piston 21 and controlled by a non-return valve 32, which enables passage of fluid only from the pressurized volume C to the variable-volume chamber of the slave piston 21. Various alternative embodiments of the hydraulic-braking device of the slave piston 21 have been proposed in the past by the present applicant (see, for example, EP-A-1 091 097 and EP-A-1 344 900). The purpose of the hydraulic-braking device is to prevent a sharp impact (and consequent noise) of the valve 7 against its seat when the valve 7 returns rapidly into the closing position following upon opening of the solenoid valve 24.

During normal operation of the known engine illustrated in FIG. 1, when the solenoid valve 24 excludes communication of the volume of pressurized fluid C with the exhaust channel 23, the oil present in the volume C transmits the movement of the master piston 16, imparted by the cam 14, to the slave piston 21, which drives opening of the valve 7. In the reverse movement of closing of the valve, as has already been said, during the final step the nose 31 enters the opening 30 causing hydraulic braking of the valve so as to prevent impact of the body of the valve against its seat, for example following upon an opening of the solenoid valve 24 that causes immediate return of the valve 7 into the closing position.

In the system described, when the solenoid valve 24 is activated, the engine valve follows the movement of the cam (full lift). An early closing of the valve can be obtained by opening the solenoid valve 24 so as to empty out the volume of pressurized fluid C and obtain closing of the valve 7 under the action of the respective return springs 9. Likewise, a late opening of the valve can be obtained by delaying closing of the solenoid valve, whereas the combination of a late opening and an early closing of the valve can be obtained by closing and opening the solenoid valve during the thrust of the corresponding cam. According to an alternative strategy, in line with the teachings of EP 1 726 790 A1 in the name of the present applicant, each intake valve can be controlled in a "multi-lift" mode, i.e., according to two or more repeated "sub-cycles" of opening and closing. In each sub-cycle, the intake valve opens and then closes completely. The electronic control unit is consequently able to obtain a variation of the timing of opening and/or closing and/or of the lift of the intake valve, as a function of one or more operating parameters of the engine. This enables the maximum engine efficiency to be obtained, and the lowest fuel consumption, in every operating condition.

FIG. 2 of the annexed drawings corresponds to FIG. 6 of EP 1 674 673 in the name of the present applicant and shows a diagram of the system for actuation of the two intake valves associated to each cylinder, in a conventional Multiair system. This figure shows two intake valves 7 associated to one and the same cylinder of an internal-combustion engine, which are controlled by a single master piston 16, which is in turn controlled by a single cam of the engine camshaft (not illustrated) acting against a plate 15. FIG. 2 does not illustrate the return springs 9 (see FIG. 1) that are associated to the valves 7 and tend to bring them back into the respective closed positions. As may be seen, in the conventional system of FIG. 2, a single master piston 16 controls the two intake valves 7 via a single volume of pressurized fluid C, the communication with discharge being controlled by a single solenoid valve 24. The volume of pressurized fluid C is in hydraulic communication with both of the variable-volume chambers C1, C2 facing two slave pistons 21 for control of the intake valves 7 of one and the same cylinder.

The system of FIG. 2 is able to operate in an efficient and reliable way above all in the case where the volumes of the hydraulic chambers are relatively small. This possibility is afforded by adopting hydraulic tappets 400 on the outside of the bushings 22, according to what has already been illustrated in detail, for example, in EP 1 674 673 B1 in the name of the present applicant. In this way, the bushings 22 may have an internal diameter that can be chosen as small as desired.

FIG. 3 of the annexed drawings is a schematic representation of the system illustrated in FIG. 2, in which it is evident that both of the intake valves 7 associated to each cylinder of the engine have the hydraulic chambers of the two slave pistons 21 permanently in communication with the pressurized volume C, which in turn may be isolated or connected to the exhaust channel 23, via the single solenoid valve 24.

The solution illustrated in FIGS. 2 and 3 enables obvious advantages as regards simplicity and economy of construction, and from the standpoint of reduction of the overall dimensions, as compared to the solution illustrated, for example, in EP 0 803 642 B1, which envisages two solenoid valves for controlling separately the two intake valves of each cylinder.

On the other hand, the solution with a single solenoid valve per cylinder rules out the possibility of differentiating control of the intake valves of each cylinder. This differentiation is, instead, desired, in particular in the case of diesel engines where each cylinder is provided with two intake valves associated to respective intake ducts having different shapes from one another in order to generate different movements of the flow of air introduced into the cylinder (see, for example, FIG. 5 of EP 1 508 676 B1). Typically, in these engines the two intake ducts of each cylinder are shaped for obtaining optimized TUMBLE-type and SWIRL-type flows of air, respectively, these flow types being fundamental for optimal distribution of the charge of air within the cylinder, which greatly affects the possibility of reducing the pollutant emissions at the exhaust.

In order to solve the above problem, the present applicant has also proposed the use of a different system layout, which makes use of a three-position and three-way solenoid valve, as described for example in EP 2 597 276 A1 in the name of the present applicant.

Once again with reference to the known systems to which the present invention can be applied, the present applicant has proposed in the past also alternative solutions for the electrically operated control valve 24, which may be, instead of a solenoid valve, an electrically operated valve of any other type, for example a valve with a piezoelectric actuator or a magnetostrictive actuator (EP 2 806 195 A1).

For the purposes of application of the present invention, all the variants described above may likewise be adopted.

FIG. 3A of the annexed drawings shows a perspective view of the main components of a known embodiment of the Multiair system of the present applicant (the components associated to one cylinder of the engine are shown), corresponding to the general scheme of FIGS. 2 and 3 of the annexed drawings. In FIG. 3A, the parts corresponding to those of FIGS. 1-3 are designated by the same reference numbers.

In the case of the embodiment of FIG. 3A, the master piston 16 is driven by the respective cam 14 via a rocker arm 140 having an intermediate portion carrying a freely rotatable roller 141 engaging with the cam 14. The rocker arm 140 has one end rotatably supported by a supporting element 142 mounted in the pre-assembled unit 20. The opposite end of the rocker arm 140 engages with the plate 15 of the master piston 16. FIG. 3A does not show the spring that recalls the plate 15 against the cam 14. FIG. 3A shows the communications of the high-pressure volume C with the solenoid valve 24 and the solenoid valve 24 with the chambers associated to the two slave pistons 21.

Technical Problem

Studies and tests conducted by the present applicant have shown that in given operating conditions the systems for variable actuation of the valves of the type indicated above are subject to pressure oscillations inside the high-pressure volume. These pressure oscillations are due to the movement of the master piston, which pressurizes the oil present in the high-pressure volume with a dynamics that depends upon various operating factors, such as the type of movement of the master piston (linked to the profile of the cam), the specific operating condition of the system, the size of the high-pressure volume. Pressure oscillations occur in particular, for example, in the "Late Intake Valve Opening" (LIVO) mode, i.e., when opening of the intake valve is delayed with respect to the conventional cycle determined by the profile of the cam, through a delayed closing of the electrically operated control valve.

Pressure oscillations in the high-pressure volume introduce various disadvantages, amongst which in particular noise and vibrations and a shorter service life of the components of the system.

Object of the Invention

The object of the present invention is to provide a system for variable actuation of the valves of an internal-combustion engine that will be able to overcome the drawback indicated above.

A further object of the invention is to achieve the above purpose by adopting means that are simple, low-cost, and safe and reliable in operation.

SUMMARY OF THE INVENTION

With a view to achieving the aforesaid objects, the subject of the present invention is a system for variable actuation of an engine valve of an internal-combustion engine, comprising:

a master piston driven directly or indirectly by a cam of a camshaft of the internal-combustion engine;

a slave piston, which drives said engine valve and is hydraulically driven by said master piston, by means of a volume of pressurized fluid interposed between the master piston and the slave piston;

an electrically operated control valve, which controls a communication of said volume of pressurized fluid with a lower pressure environment, which is connected to a fluid accumulator; and an electronic control unit for controlling said electrically operated control valve on the basis of one or more parameters indicating the operating conditions of the engine and/or of the system for variable actuation of the engine valves, said oscillation dampening device comprising an additional volume adapted for receiving fluid from said volume of pressurized fluid only when said pressure exceeds a maximum threshold value.

Tests conducted by the present applicant have shown that, thanks to the aforesaid characteristics, the problem of pressure oscillations in the volume of fluid at high pressure is solved in a simple and efficient way, substantially reducing the vibrations and noise of the system and consequently enabling a longer service life of its components.

The invention may be applied to any type of system for variable actuation of the engine valves of the type comprising a master piston, a slave piston, and a volume of pressurized fluid interposed between them that can be connected with a low-pressure environment for decoupling the engine valve from the actuation cam. The invention may be applied irrespective of the architecture of the system (with one electrically operated control valve or with two electrically operated control valves for control of the two intake valves of one and the same cylinder, and with electrically operated valves of a normally open type or a normally closed type). The electrically operated valve may be of the two-way, two-position type, or of the three-way, three-position type, or of any other type and may envisage actuation by means of a solenoid or else any other type of actuator (for example a piezoelectric or magnetostrictive actuator). The invention may also apply to systems for variable actuation of the engine exhaust valves.

In a first embodiment of the invention, the aforesaid additional volume is constituted by an auxiliary chamber that is in communication with the above volume of pressurized fluid and is defined by the movement of a movable member against the action of a return spring, the spring having a load such that the movable member displaces against the action of the spring, thus creating the additional volume only when the pressure in the volume of pressurized fluid exceeds the aforesaid maximum threshold value.

In the above mentioned first embodiment, the oscillation dampening device operates automatically whenever in the high-pressure volume a pressure peak above the maximum threshold value is generated.

In a second embodiment of the invention, the additional volume is constituted by an auxiliary chamber that is in communication with the volume of pressurized fluid and is defined by movement of a movable member the position of which is controlled by an electrically driven actuator, the electronic control unit being programmed for controlling the actuator so as to cause displacement thereof and thus create the aforesaid additional volume when the pressure in the volume of pressurized fluid exceeds the above maximum threshold value.

In this second embodiment, the electronic control unit controls in closed-loop mode the aforesaid actuator of the oscillation dampening device on the basis of the signal at output from at least one pressure sensor that is designed to detect the pressure in the volume of pressurized fluid, or else is programmed for operating in open-loop mode, on the basis of stored maps, as a function of the operating conditions of the engine and/or of the system for variable actuation of the engine valves.

The advantage of this second embodiment lies in the fact that the triggering pressure threshold is not fixed as in the solution with automatic operation, but can be varied as a function of the operating conditions. Moreover, the actuator associated to the damper device may be either of the on/off type or of a proportional type.

In both of the aforesaid embodiments, the communication of the auxiliary chamber with the volume of pressurized may be a permanently opened communication, which preferably includes a restricted passage in order to isolate the high-pressure volume in regard to possible pressure oscillations within the aforesaid auxiliary chamber of the device for dampening oscillations.

In a first solution, the aforesaid auxiliary chamber and the aforesaid movable member of the oscillation dampening device are provided within the body of an autonomous member, associated to the high-pressure volume. In variants of said solution, the auxiliary chamber and the movable member are provided within the body of the slave piston, or within the body of the master piston, or within the body of the electrically operated control valve.

BRIEF DESCRIPTION OF THE DRAWINGS

Further characteristics and advantages of the invention will emerge from the ensuing description with reference to the annexed drawings, which are provided purely by way of non-limiting example and in which.

DETAILED DESCRIPTION OF SOME PREFERRED EMBODIMENTS

Figure 1:
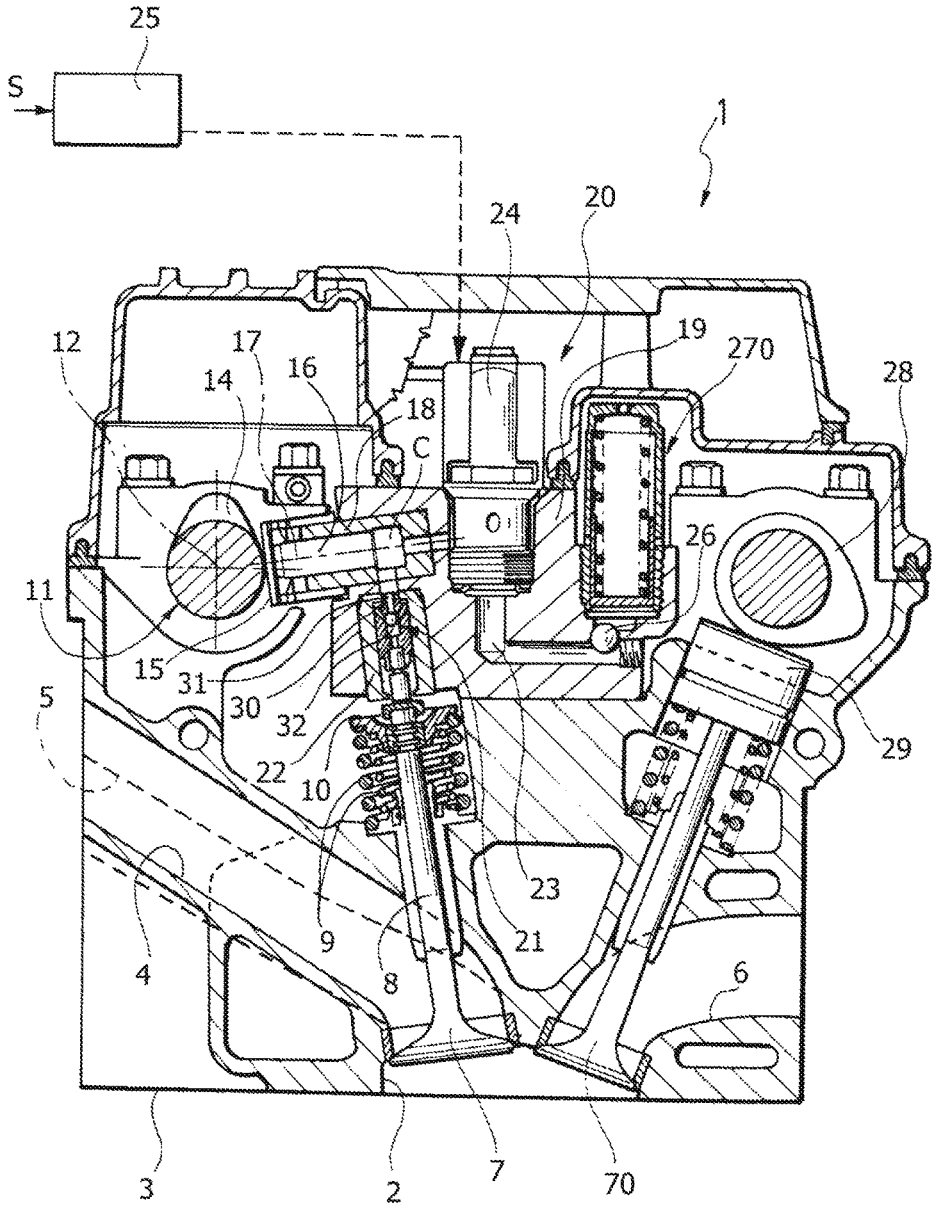
FIG. 1 is a cross-sectional view of a cylinder head of an internal-combustion engine provided with a system for variable actuation of the intake valves according to the known art.
Figure 2:
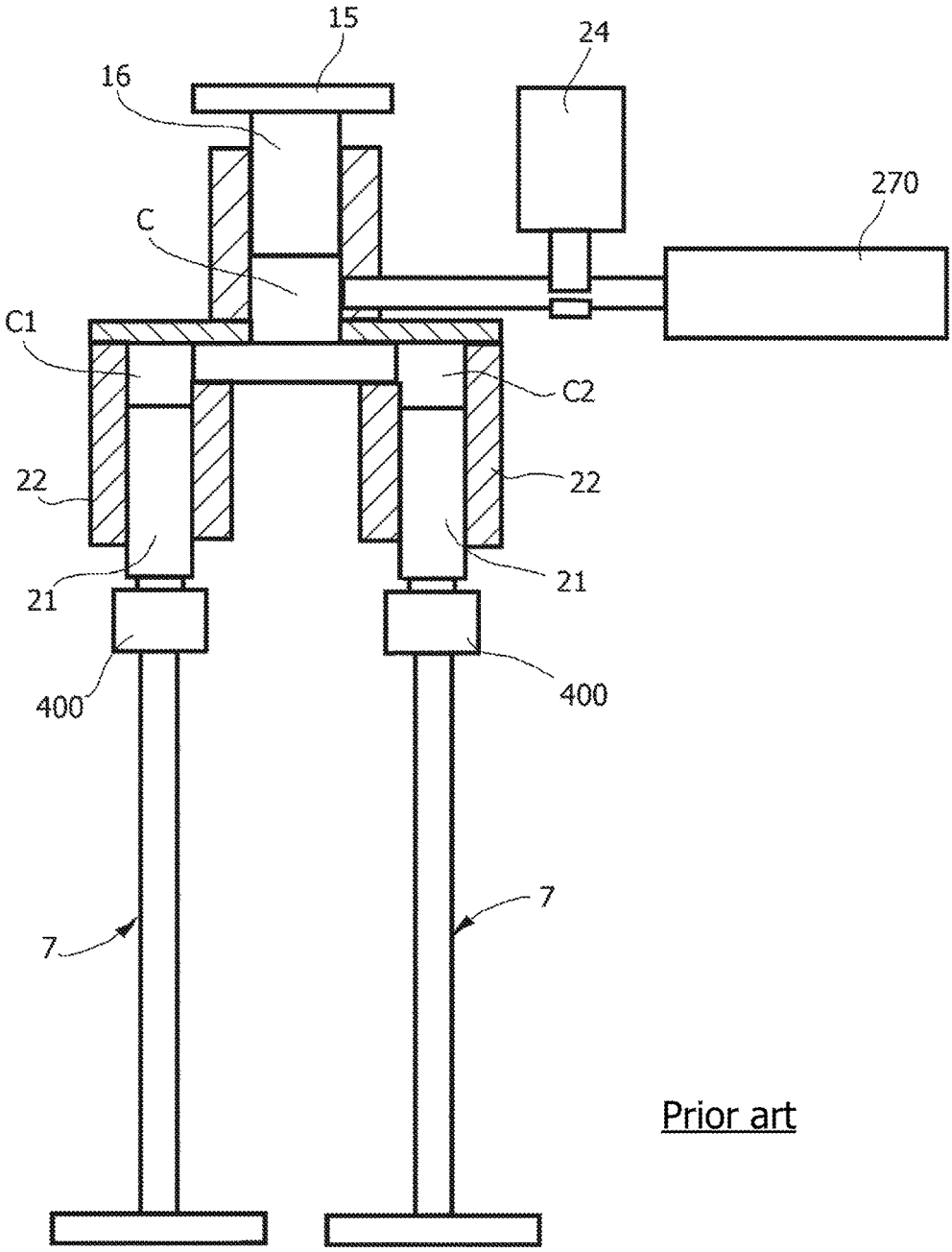
FIG. 2 is a diagram of a system for variable actuation of the valves of an internal-combustion engine according to the known art.
Figure 3:
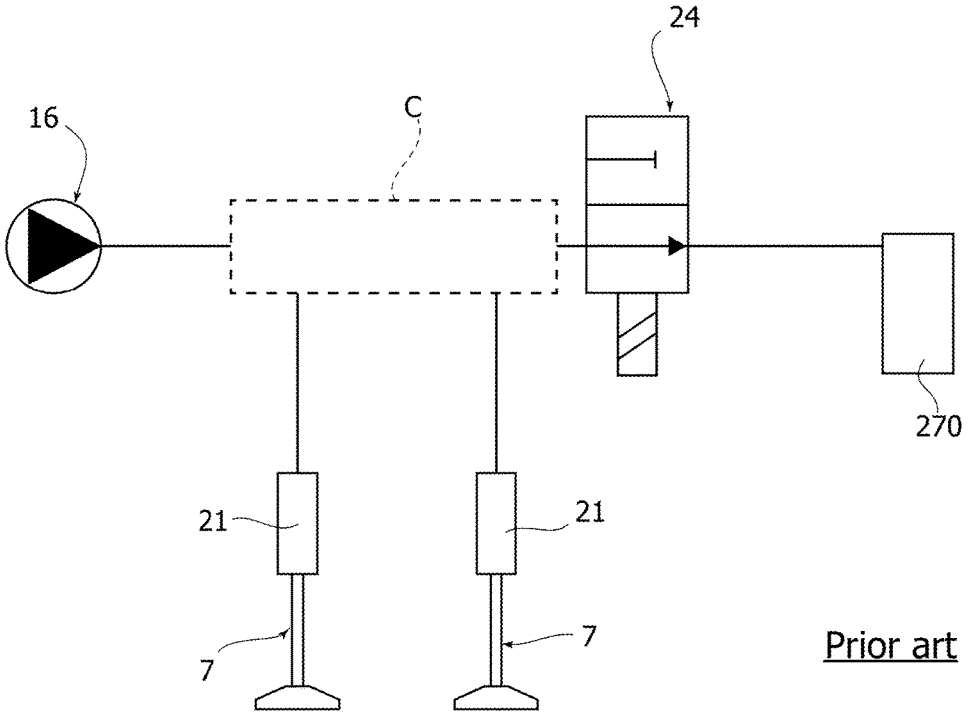
FIG. 3 is a further diagram of the system of FIG. 2.
Figure 3A:
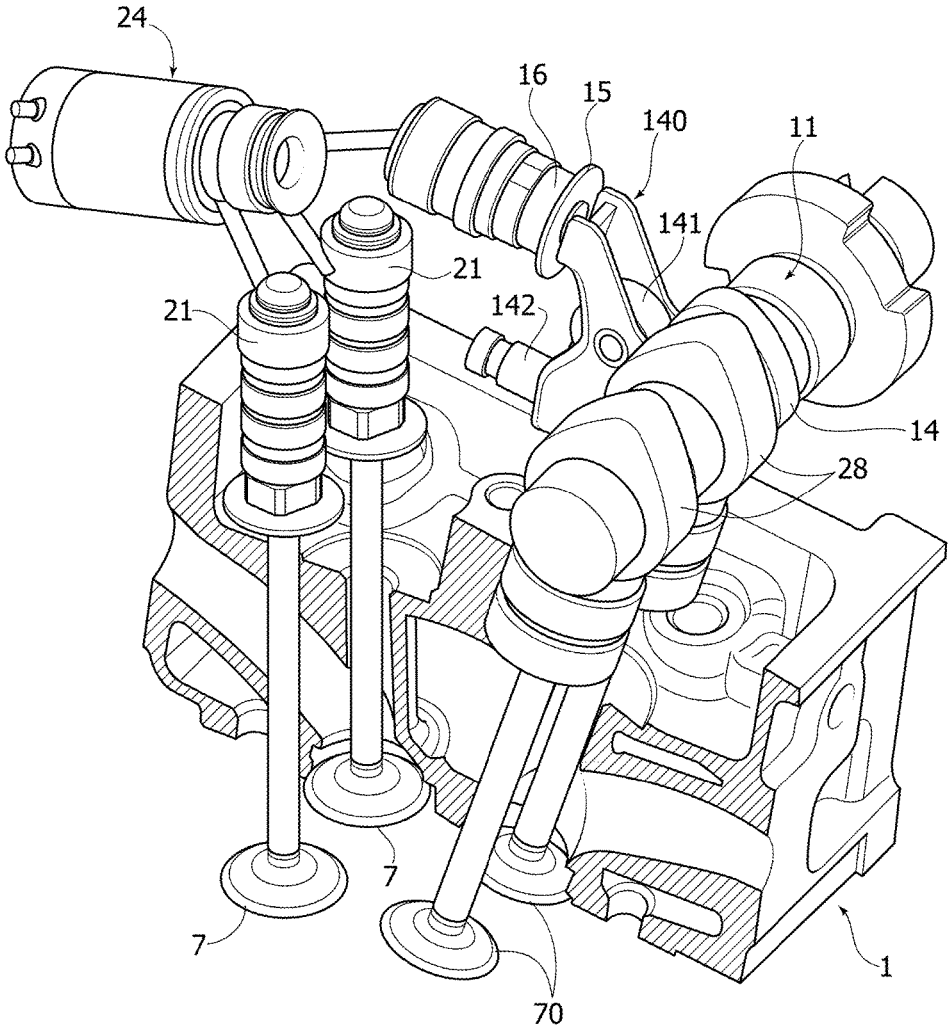
FIG. 3A is a perspective view of an embodiment of the known system represented schematically in FIGS. 2 and 3.
Figure 4:
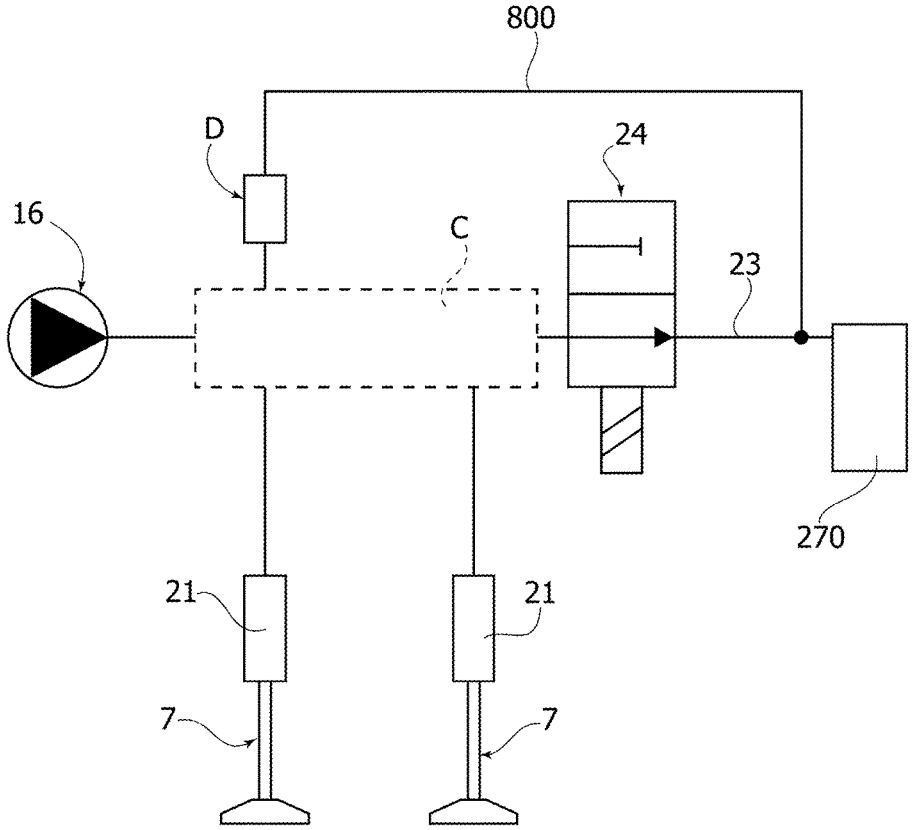
FIG. 4 is a diagram similar to that of FIG. 3 that shows the basic principle of the system according to the invention.

FIGS. 1-3 and 3A, which relate to the prior art, have already been described above. FIG. 4 of the annexed drawings is a schematic view similar to that of FIG. 3 and regards the system for variable actuation of the valves of an internal-combustion engine according to the present invention. In FIG. 4, the parts corresponding to those of FIG. 3 are designated by the same reference numbers. The main difference of the system according to the invention as illustrated in FIG. 4 as compared to the known system of FIG. 3 lies in the fact that the high-pressure volume C is connected to a device for damping pressure oscillations D. A recirculation line 800 connects the rear side of the device D with the low-pressure line 23, or with the accumulator 270, according to what will be illustrated in detail in what follows.

Figure 4A:
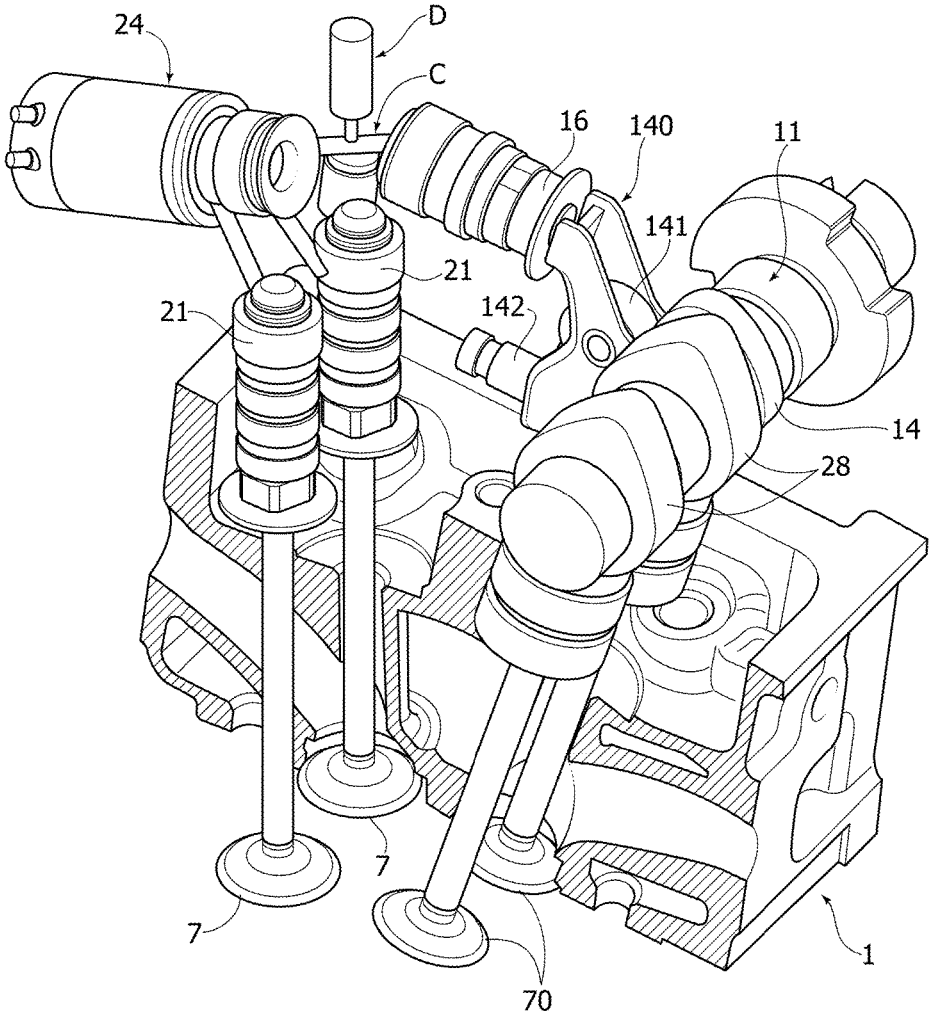
FIG. 4A shows the same embodiment of FIG. 3A, modified according to the present invention.
Figure 5A:
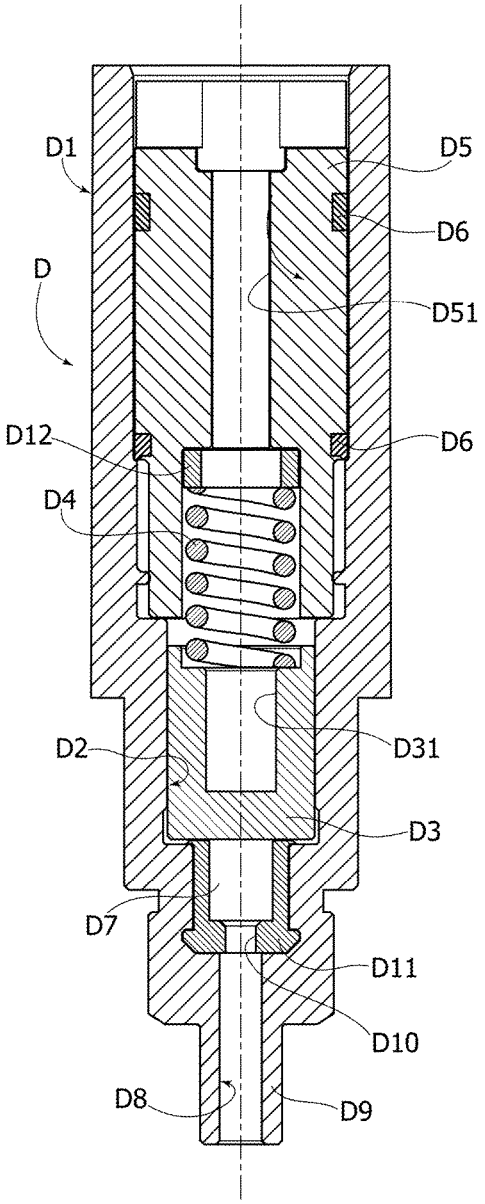
FIGS. 5A and 5B are cross-sectional views that show the member for dampening oscillations forming part of the solution of FIG. 4A, in two different operating conditions.
Figure 5B:
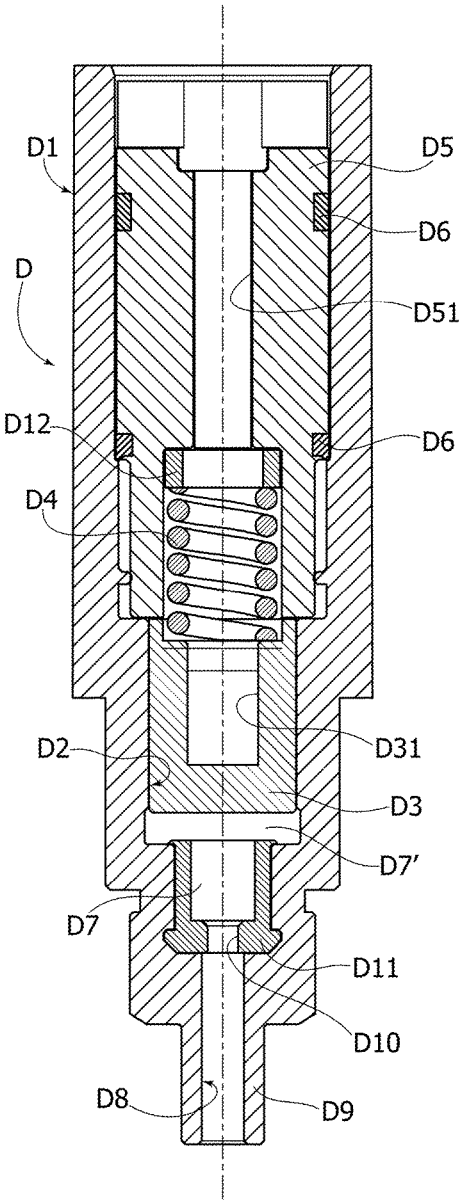

FIGS. 4A, 5A, and 5B show a first example of embodiment of the system according to the invention, in which the dampening oscillation device D is constituted as autonomous member associated to the high-pressure volume C. One damper device D is provided for each cylinder of the engine. FIG. 4A shows the same perspective view as that of FIG. 3A, modified according to the teachings of the present invention. As will be seen, in the example illustrated in FIG. 4A, the device D is directly associated to a channel for communication between the chamber of the master piston and the solenoid valve 24, this channel forming part of the high-pressure volume C. The damper device D of this embodiment is illustrated in cross-sectional view and at an enlarged scale in FIGS. 5A, and 5B, in two different operating conditions. The device D of this embodiment is received in a corresponding seat formed in the pre-assembled unit 20 already described above, which carries all the elements of the system for variable actuation of the engine valves. As already mentioned there may be provided a separate unit 20 for each cylinder.

With reference to FIGS. 5A and 5B, which are provided purely by way of non-limiting example, the oscillation dampening deviceD of this embodiment comprises a cylindrical body D1 having an internal cylindrical cavity D2 slidably mounted within which is a movable member D3. A helical spring D4 is interposed axially between the movable member D3 and a bushing D5 received and blocked within the cylindrical cavity of the body D1 with interposition of seal rings D6. The helical spring D4 tends to maintain the movable member D3 in an end-of-travel position, in the direction of a chamber D7, which is defined within the cylindrical body D1 and communicates with a hole D8 of an end connector D9, designed to be set in hydraulic connection with the high-pressure volume C, as may be seen in FIG. 4A. The chamber D7 communicates with the hole D8 of the connector D9 via a restricted passage D10 of a predetermined diameter, formed in the bottom wall of a cup-shaped element D11 that is secured, by being driven into the cylindrical body D1 or with a threaded connection, against a bottom wall of the internal cavity D2 of the device, in which the aforesaid hole D8 gives out. In the example illustrated, the movable member D3 has a cup-shaped body with a bottom wall facing the chamber D7 and an internal cavity D31 that faces the spring D4 and is in communication with the low-pressure environment of the circuit through the internal cavity D51 of the bushing D5, the end portion of the internal cavity D2 of the body D1, and the recirculation line 800 (see FIG. 4). Once again in the case of the specific example illustrated, axially interposed between the spring D4 and the bushing D5 is a ring D12.

As already mentioned, the oscillation dampening deviceD is prearranged in such a way that the chamber D7 is permanently in communication, via the restricted passage D10 and the hole D8 of the connector D9, with the high-pressure volume C associated to a cylinder of the engine.

FIG. 5A shows the device D in the inactive resting condition, in which the spring D4 maintains the plunger D3 in an end-of-travel position, against an annular contrast portion formed in the internal cavity D2 of the body D1. In this condition, the volume internal to the device D that is in communication with the high-pressure volume of the system for actuation of the valves is substantially that of the chamber D7, defined within the cup-shaped element D10 and limited at the top by the movable member D3, held in its resting position (the lowest position, as viewed in the drawings). The volume internal to the device D further comprises the restricted hole D11 and the duct D8. This internal volume is always filled with fluid during normal operation of the system for variable actuation of the engine valves, being permanently in communication with the high-pressure volume C of the system.

During operation of the system for variable actuation of the engine valves, in the case where the pressure of the fluid in the high-pressure volume C presents oscillations with peaks higher than a predetermined threshold value, markedly higher than the mean value of the pressure that is set up in the volume C during normal driving of the slave pistons 21 by the master piston 16, these pressure peaks manage to overcome the action of the spring D4, causing displacement of the movable member D3 against the spring D4 and consequent formation within the cavity D2 of the device D of an additional volume D7' formed between the annular contrast portion of the cavity D2 that defines the resting position of the movable member D3 and the surface of the movable member facing it. In other words, this additional volume basically corresponds to the portion of the internal cavity D2 that is left free by the movable member D3 when this moves away from the resting position illustrated in FIG. 5A so as to move into the operating position of FIG. 5B.

The characteristics of the spring D4 and the loading of the spring in its resting position (which may also be varied using rings D12 of a different height) are predetermined in such a way that the pressure of fluid that is able of cause displacement of the movable member D3 is a threshold value notably higher than the mean pressure value that is set up in the high-pressure volume C when the master piston controls each slave piston 21 in normal operating conditions. Consequently, the damper device D enters into action only when the pressure in the volume C has anomalous oscillations and consequent pressure peaks above the threshold value.

Moreover, sizing of the device D is chosen in such a way that the additional volume D7' that is created in the case of pressure peaks is the one necessary and sufficient for dampening the pressure oscillations and does not appreciably alter the desired stroke of the slave pistons 21 caused by the movement of the master piston.

Purely by way of example, the additional volume D7' that is set up in the case of pressure peaks corresponds to approximately 1% of the total high-pressure volume C associated to each cylinder of the engine.

In summary, the damper device according to the invention is able to increase the overall volume of the high-pressure environment whenever there arise pressure peaks, thus attenuating the pressure oscillations accordingly. Dampening of the oscillations produces the beneficial effect of reducing drastically or even eliminating altogether vibrations and noise of the system, with consequent advantage also as regards the service life of the components of the system. For operation of the system, it is necessary for the damper device D to "see" always the high-pressure volume C in which the pressure oscillation is to be attenuated.

The embodiment of FIGS. 5A and 5B is characterized in that it entails an automatic triggering of the damper whenever the pressure exceeds the threshold value defined above, for which the spring D4 is provided.

It is possible to pre-determine the increase in volume D7' that is necessary, knowing the amplitude of the pressure oscillations that are to be attenuated and sizing accordingly the diameter of the movable member and adopting a spring having the necessary stiffness.

The restricted passage D10 has the function of filtering the pressure oscillations that are generated within the damper device D, preventing propagation thereof into the high-pressure volume C.

A dynamic seal between the body D2 of the device and the movable member D3 may be obtained by means of an adequate control of the coupling clearance, thus allowing a minimum leakage of fluid towards the low-pressure environment through the recirculation line 800, or else by pre-arrangement of dynamic seals, made, for example, of plastic material, which are designed to prevent leakage. In any case, when the plunger is in its end-of-travel position in the direction of the spring D4, it comes into contact with an end surface of the bushing D5, closing communication with the hole D51.

Figure 6:
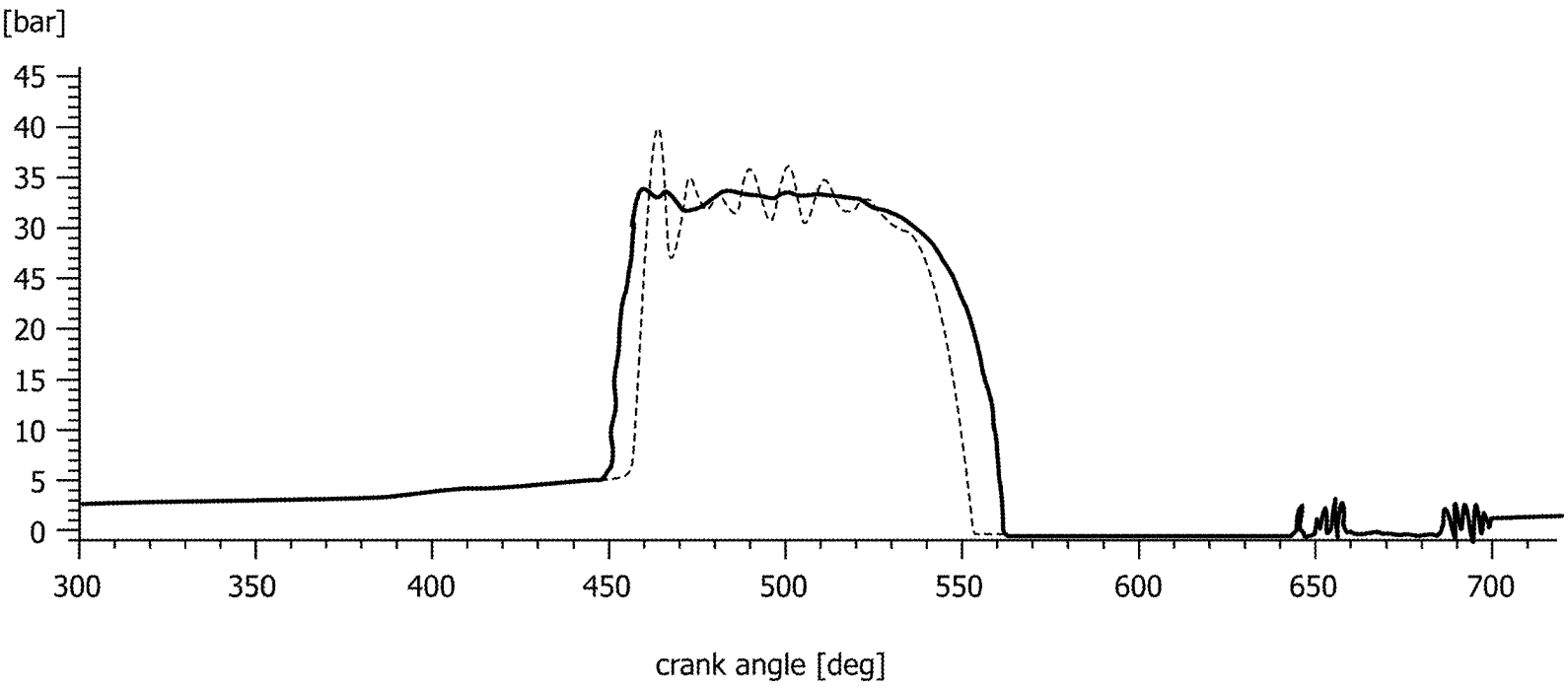
FIGS. 6 and 7 are plots that show the substantial reduction and/or elimination of the pressure oscillations in the high-pressure volume, which can be obtained with the system according to the invention.

FIG. 6 shows by way of example the attenuation of the pressure oscillations that can be obtained with an oscillation dampening device D of the type illustrated in FIGS. 5A and 5B.

In FIG. 6, the plot represented with a dashed line indicates the variation of pressure in the high-pressure volume C as a function of the crank angle in a system according to the known art, i.e., without the damper device.

The plot of FIG. 6 shows an example of embodiment in "LIVO" mode in which the intake valve opens with a delay with respect to what would be obtained by the cam profile. In the case illustrated, the increase in pressure that causes opening of the intake valve is in fact at a crank angle of approximately 450°, i.e., substantially at half of the descent of the engine piston from top dead centre (360°) to bottom dead centre (540°). As may be seen, in the operating step of actuation of the engine valve, in which the solenoid valve 24 is closed for pressurizing the volume C and enabling the master cylinder 16 to drive via the volume of pressurized oil displacement of each slave piston 21, the pressure presents rather significant oscillations around its mean value, with pressure peaks well above the aforesaid mean value.

The plot represented with a solid line in FIG. 6 shows the corresponding variation of the pressure in the volume C in the case of a system provided with the oscillation dampening device of the type of FIGS. 5A and 5B. As may be seen, all other conditions being the same, the pressure oscillations in the volume C are markedly attenuated.

Figure 7:
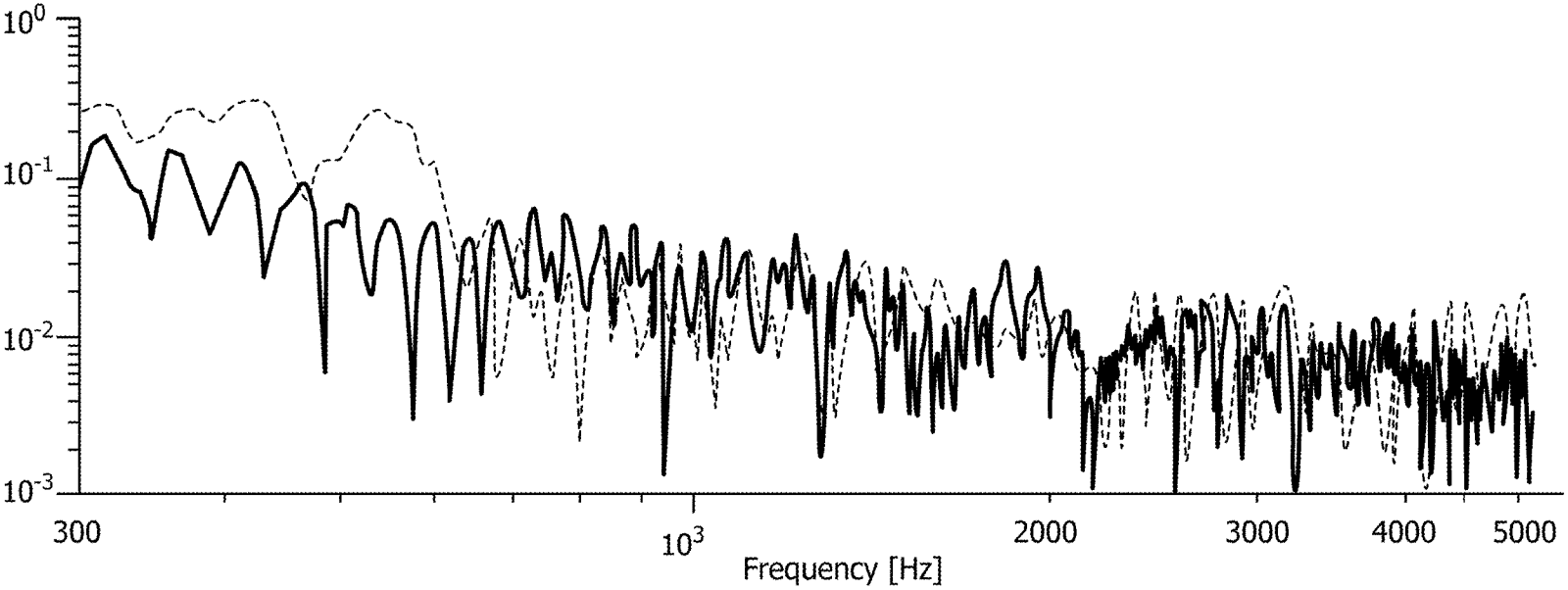

FIG. 7 shows the frequency response regarding the variation of the pressure in the high-pressure volume, respectively in the case of the known system, without the oscillation dampening device (dashed line), and in the case of the system provided with a oscillation dampening device according to the invention. It may be noted that, in the example considered herein, at the lower frequencies there is a considerable reduction of the amplitude of the pressure oscillations.

Figure 8:
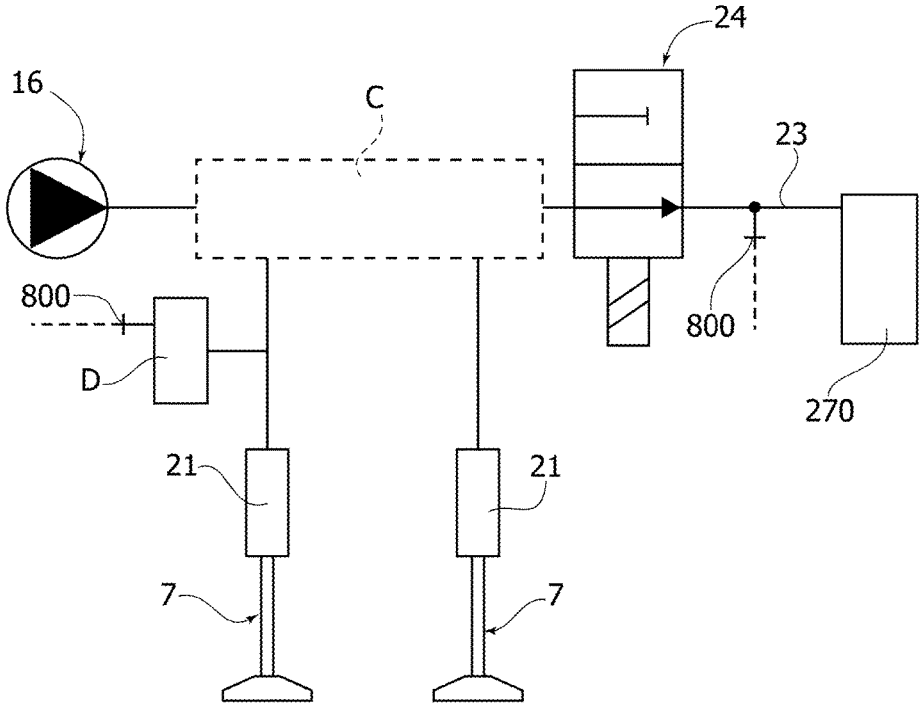
FIG. 8 shows a variant of FIG. 4.

FIG. 8 is a schematic illustration of a variant of the system according to the invention, where the oscillation dampening device D is associated to one (or possibly to each) of the two slave pistons 21.

Figure 9:
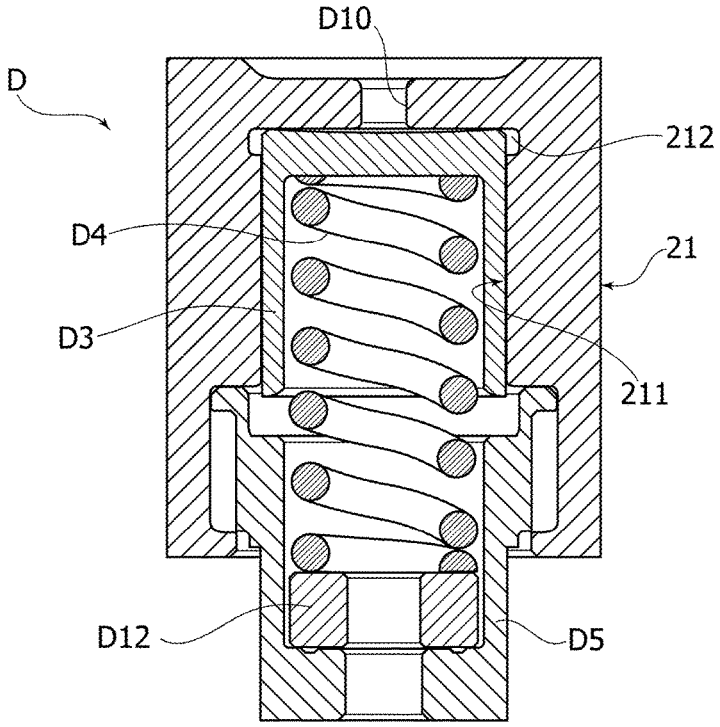
FIG. 9 is a cross-sectional view of an embodiment of a oscillation dampening device that can be used in the system of FIG. 8.
Figure 10:
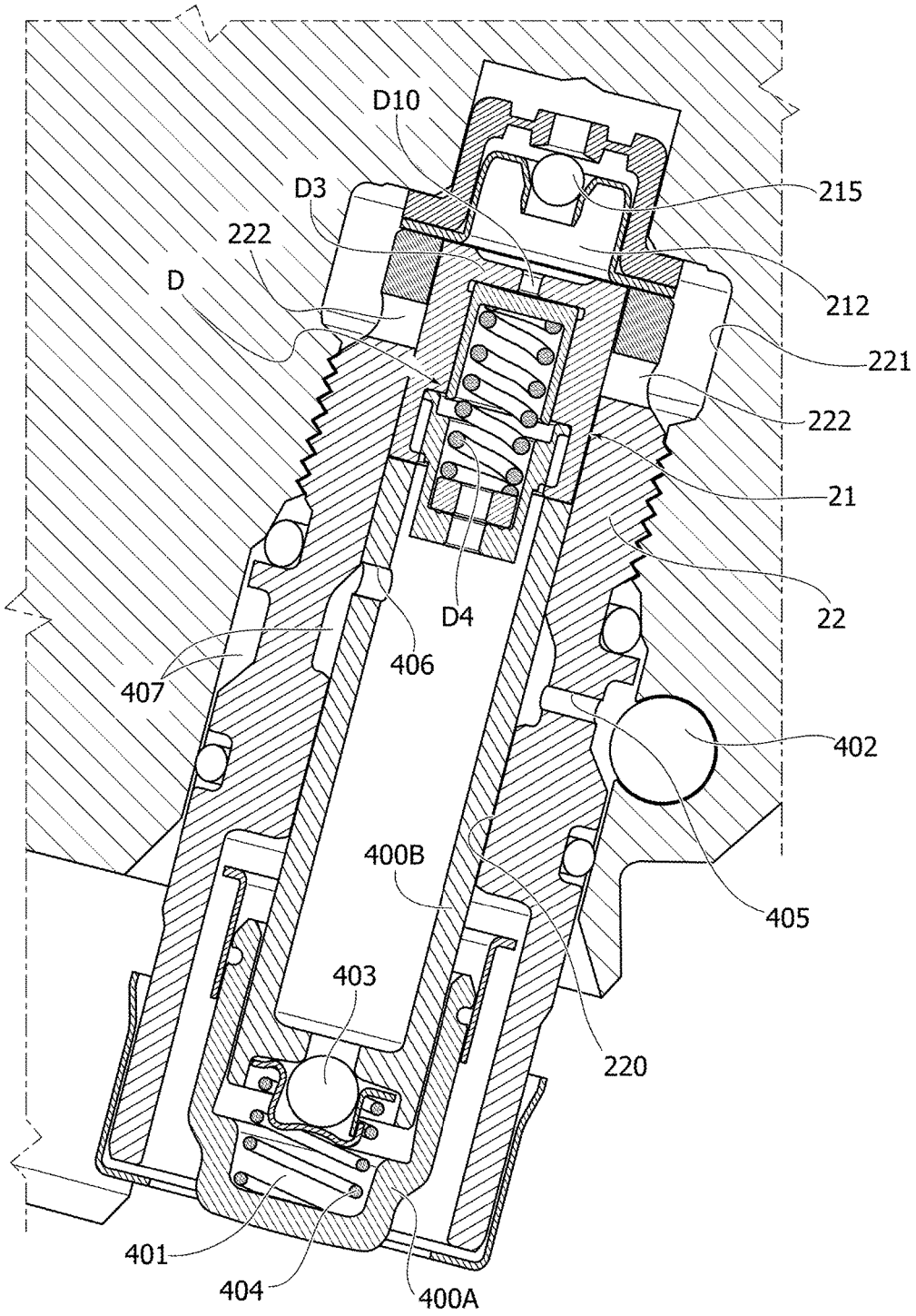
FIG. 10 is a cross-sectional view of the slave-piston assembly of the system of FIG. 8, which incorporates the oscillation dampening device of FIG. 9.

FIGS. 9 and 10 refer to an example of embodiment of this variant. FIG. 10 is a cross-sectional view at an enlarged scale of a slave piston 21, according to a known embodiment of the Multiair system, here modified for receiving the oscillation dampening device D. FIG. 9 shows the oscillation dampening device D just by itself.

With reference to FIG. 10, the piston 21 has a body shaped like a cup turned upside down slidably mounted within a bushing 22 received in a fluid-tight way within a seat of its own in the body of the unit associated to each cylinder of the engine.

The slave piston 21 is prearranged for driving the stem 8 of the respective valve 7 by interposition of a hydraulic tappet 400 (as already illustrated schematically in FIG. 2).

The tappet 400 has an outer tappet element 400A set within a widened mouth of the bushing 22, on the outside of the cylindrical cavity 220 within which the slave piston 21 is slidably guided. The outer tappet element 400A is slidably mounted on the bottom end of an inner tappet element 400B. The inner tappet element 400B has a cylindrical body slidably mounted in the cavity 220 and a top end in contact with the bottom end (as viewed the drawing) of the piston 21. The inner tappet element 400B has an internal cavity that receives pressurized oil from the lubrication circuit of the engine through a channel 402 formed in the body of the unit 20, and through chambers 407 defined by circumferential grooves formed in the inner and outer surfaces of the bushing 22 and through radial holes 405, 406 formed in the wall of the bushing 22 and in the element 400B. The pressure of the oil within the element 400B is lower than the pressure that is set up in the high-pressure volume C when the master piston is in the active phase.

From the internal cavity to the tappet element 400B, the oil can pass into the internal chamber 401 defined between the tappet elements 400A and 400B, through a non-return valve having a ball open/close element 403 recalled into the closing position by a spring 404.

Adjacent to the top end of the bushing 22, defined around the bushing 22 is a circumferential chamber 221 which communicates, by means of a duct not illustrated, with the high-pressure volume C. The chamber 221 communicates also with radial holes 222 formed through the wall of the bushing 22.

In the steps in which the top surface of the slave piston 21 is below the holes 222, as viewed in the drawing, the chamber 212 within the bushing 22 that faces the piston 21 is in communication with the pressurized volume through the holes 222 and the circumferential chamber 221. Consequently, during opening of the engine valve, the oil pushed by the master piston 16 can enter the chamber of the slave piston 21 and cause movement thereof, with consequent movement of opening of the engine valve, via the hydraulic tappet 400. During closing of the engine valve, the oil can return into the volume C passing through the same passages. However, in the final step of the movement of closing of the engine valve, i.e., when the piston 21 has occluded the holes 222, the movement of the valve is braked, owing to the fact that the oil leaving the internal cavity of the bushing 22 is forced to flow through one or more restricted passages (not visible in FIG. 10) made in the vicinity of the holes 222 in the bushing 22 (according to the principle known from the document EP-A-1 344 900 filed in the name of the present applicant).

In the reverse phase of opening of the valve, during the initial part of the movement of opening of the valve, the oil coming from the pressurized volume C can flow only within a chamber 212 above of the piston 21 passing through a non-return valve 213 carried by a cap 215 mounted on the top end of the bushing 22. Once the top surface of the piston 21 has dropped below the level of the holes 222, the oil coming from the pressurized volume C can flow also, and above all, through the chamber 221 and the holes 222.

The details regarding the slave piston 21 and the hydraulic-braking device are not in any case described herein any further in so far as they can be obtained in any one known way and do not fall, taken in themselves, within the scope of the invention.

According to this embodiment of the invention, integrated within the known arrangement described with reference to FIG. 10 is a oscillation dampening device D, illustrated by itself at an enlarged scale in FIG. 9.

With reference to FIG. 9, the cup-shaped body of the slave piston 21 is used also as body of the oscillation dampening device D. The cup-shaped body of the piston 21 has an internal cylindrical cavity 211 slidably mounted within which is the movable member D3 of the oscillation dampening device D, which also has a cup-shaped body. This movable member D3 is recalled into a resting position against the bottom wall of the cup-shaped body of the piston 21 by a helical spring D4 that is axially interposed between the bottom wall of the movable member D3 and the bottom wall of a further cup-shaped element D5 rigidly connected to the body of the piston 21. The two cup-shaped bodies of the elements D3 and D5 have their cavities facing one another in order to receive the spring D4 between them. The helical spring D4 rests against the bottom of the element D5 preferably via interposition of a spacer ring D12 (the thickness of which may be chosen as a function of the loading to be assigned to the spring, which determines the pressure that brings about triggering of the damper device) and tends to maintain the movable member D3 in the resting position.

The chamber 212 defined within the piston 21 by the movable element D3 communicates with the high-pressure volume C via a restricted opening D10 formed in the bottom wall of the cup-shaped body of the piston 21. In the case of pressure peaks in the high-pressure volume C, which lead the pressure to exceed the aforesaid threshold value, the movable member D3 displaces against the action of the spring D4, thus creating an additional volume in the space left free within the cavity 211 by the movable member D3. This additional volume is, as has been said, in communication with the high-pressure volume C and consequently causes a simultaneous increase of the latter in such a way as to dampen the pressure oscillations, without on the other hand modifying in any appreciably way the travel imparted on the engine valve. This is obtained in so far as the characteristics of the spring, its loading, and the dimensions of the additional volume are predetermined in such a way as to produce only a dampening of the pressure peaks of the volume C, when the pressure therein exceeds the predetermined value.

Figure 11:
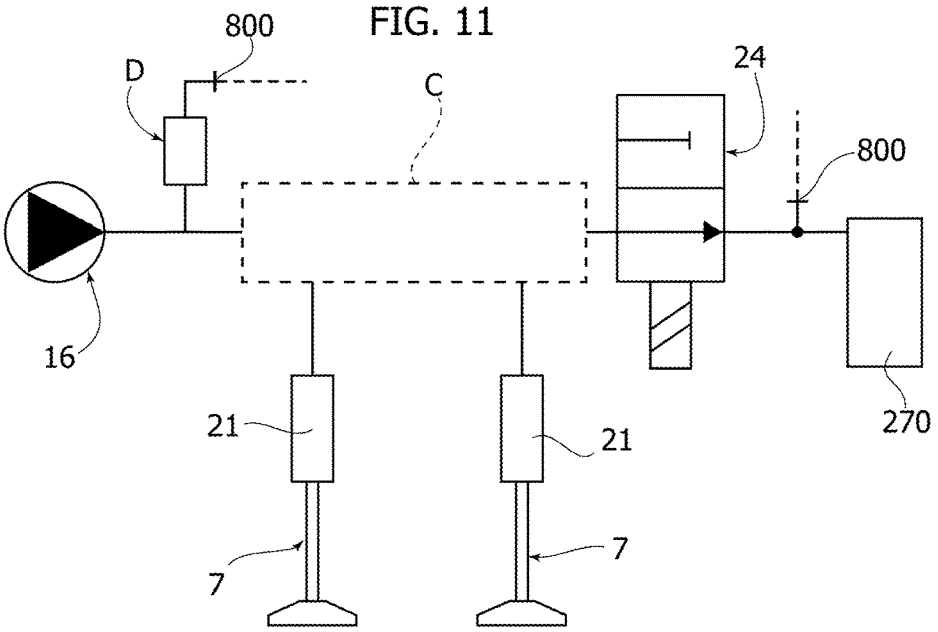
FIG. 11 shows a further variant of the system of FIG. 4.
Figure 11A:
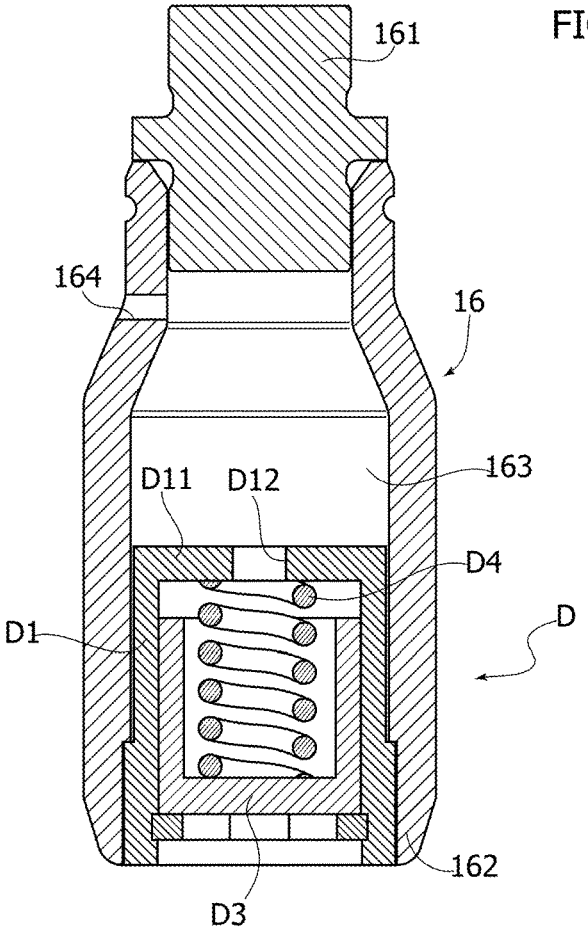
FIG. 11A illustrates an embodiment of the member for dampening oscillations incorporated in the master piston of the system of FIG. 11.

FIGS. 11 and 11A illustrate a further variant of the system according to the invention, in which the oscillation dampening device D is made and integrated in the body of the master piston 16. The master piston 16 has, in a way in itself known, an end portion 161 designed to receive, directly or indirectly, the thrust of an actuation cam, and an opposite end portion 162 facing the high-pressure volume C. In this case, the body of the master piston 16 has a tubular conformation, with an internal cavity 163 rigidly connected inside which is the body D1 of the oscillation dampening device D, which in this case is in the form of a cup-shaped element with an open mouth facing the end 162 that faces the high-pressure volume C. Slidably mounted within the body D1 is a movable member D3, which is also cup-shaped and has a bottom wall facing the high-pressure environment C. On the opposite side of its bottom wall the movable member D3 is subject to the thrust of a spring D4 that is interposed between the member D3 and a bottom wall D11 of the cup-shaped body D1. The bottom wall D11 has a central hole D12 that sets the chamber containing the spring D4 in communication with the internal cavity 163 of the body of the piston 16. The chamber 163 in turn communicates with the low-pressure environment of the circuit for supply of the oil through a hole 164 formed in the wall of the body of the master piston 16 and through the recirculation line 800 (FIG. 11). As an alternative, in the case where a dynamic seal constituted by rings made of plastic material set between the movable member D3 and the body D1 is used, the communication between the chamber and the low-pressure environment may be eliminated.

During normal operation of the system, the master piston 16 moves under the action imparted by the cam, without the movable member D3 moving away from its resting position. However, in the case where in the high-pressure environment C there arise pressure peaks above a predetermined threshold value, the plunger D3 moves away from its resting position, overcoming the action of the spring D4 and leaving an additional volume inside the piston 16 free, which causes an attenuation of the pressure oscillations.

Figure 12:
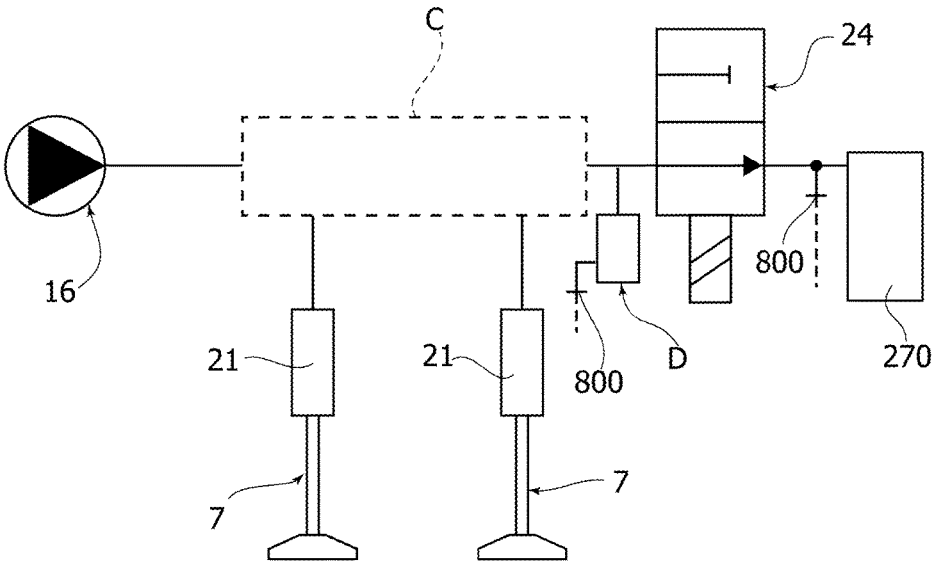
FIG. 12 shows a further variant of the system of FIG. 4.

As schematically illustrated in FIG. 12, the oscillation dampening device could also be associated to, and/or integrated in, the electrically operated control valve 24.

All the embodiments described above envisage use of a device for dampening pressure oscillations that is designed to intervene automatically, whenever in the high-pressure volume C there arise pressure peaks above a predetermined threshold value.

Figure 13:
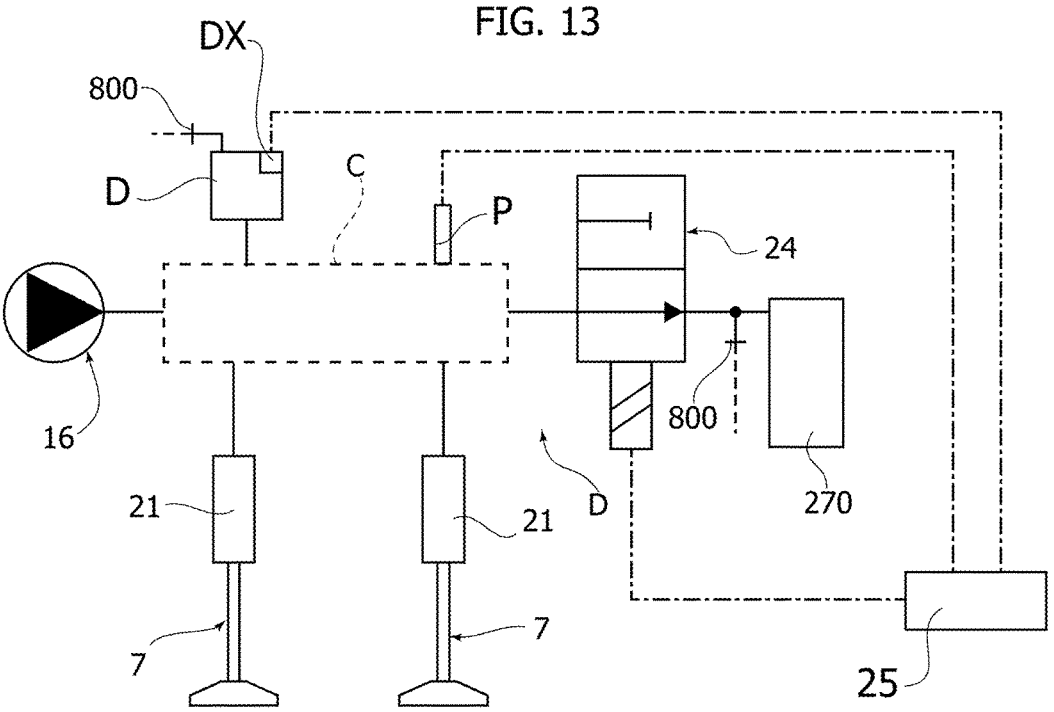
FIG. 13 is a diagram of a further embodiment of the system according to the invention that uses a oscillation dampening device with controlled triggering.

FIG. 13 illustrates a variant in which the device D is of a controlled type. In this case the device includes an electrically driven actuator DX (for example, a solenoid, or a piezoelectric actuator, or a magnetostrictive actuator) designed to cause a displacement of the movable member D3 that gives rise to a simultaneous increase of the high-pressure volume in order to dampen pressure oscillations that are set up in this volume.

The scheme of FIG. 13 may be applied to any embodiment of the damper device D, for example to any of the embodiments of FIGS. 5A, 5B, 9, 10, 11A, and 12, by providing the aforesaid actuator DX in order to govern a controlled and desired movement of the movable member D3.

The actuator DX is controlled by the electronic control unit 25 for example in a closed-loop mode, on the basis of the signal from one or more sensors P designed to detect the pressure in the high-pressure volume C, or else in an open-loop mode, on the basis of maps stored as a function of the different operating conditions of the system and/or of the engine.

As already mentioned above, the advantage of a controlled device of the type illustrated in FIG. 13 lies in the fact that the threshold value triggering the actuator DX is not always the same as in self-triggering devices, but rather can be varied according to the operating conditions. The actuator DX may be of an ON/OFF type or else of a proportional type.

Naturally, without prejudice to the principle of the invention, the embodiments and the details of construction may vary widely with respect to what has described and illustrated herein purely by way of example, without thereby departing from the scope of the present invention.

What is claimed is:

1. A system for variable actuation of an engine valve of an internal-combustion engine, comprising:

a master piston driven directly or indirectly by a cam of a camshaft of the internal-combustion engine;

a slave piston, which drives said engine valve and is hydraulically driven by said master piston, by means of a volume of pressurized fluid interposed between the master piston and the slave piston;

an electrically operated control valve, which controls a communication of said volume of pressurized fluid with a lower pressure environment, said lower pressure environment being connected to a fluid accumulator; and an electronic control unit for controlling said electrically operated control valve on the basis of one or more parameters indicating the operating conditions of the engine and/or of the system for variable actuation of the engine valve, a device for dampening pressure oscillations in the volume of pressurized fluid connected to said volume of pressurized fluid, and said oscillation dampening device comprising an additional volume adapted for receiving fluid from said volume of pressurized fluid only when said pressure exceeds a maximum threshold value.

2. The system according to claim 1, further comprising an auxiliary chamber comprising said additional volume, said auxiliary chamber in communication with said volume of pressurized fluid and defined by a movement of a movable member against the action of a return spring, said spring having a load such that said movable member displaces against the action of the spring, thus creating said additional volume, only when the pressure in the volume of pressurized fluid exceeds the aforesaid maximum threshold value.

3. The system according to claim 2, wherein the communication of the aforesaid auxiliary chamber with the volume of pressurized fluid is a permanently opened communication.

4. The system according to claim 3, wherein said permanently opened communication includes a restricted passage.

5. The system according to claim 2, wherein said auxiliary chamber and said movable member are provided within the body of the oscillation dampening member, said body comprising a separate element.

6. The system according to claim 2, wherein said auxiliary chamber and said movable member are provided within the body of said slave piston.

7. The system according to claim 2, wherein said auxiliary chamber and said movable member are provided within the body of said master piston.

8. The system according to claim 2, wherein said auxiliary chamber and said movable member are provided within the body of said electrically operated control valve.

9. The system according to claim 1, further comprising an auxiliary chamber in communication with said volume of pressurized fluid and defined by a movement of a movable member, the position of the movable member being controlled by an electrically driven actuator, said electronic control unit being programmed for controlling said actuator so as to cause a displacement thereof which creates the aforesaid additional volume when the pressure in the volume of pressurized fluid exceeds said maximum threshold value.

10. The system according to claim 9, wherein the threshold pressure value that triggers the actuator is varied as a function of the operating conditions.

11. The system according to claim 9, wherein said electronic control unit controls the actuator of said oscillation dampening device in a closed-loop mode, on the basis of a signal from at least one pressure sensor adapted to detect the pressure in the volume of pressurized fluid.

12. The system according to claim 9, wherein said electronic control unit is programmed for controlling the actuator of the movable member of the oscillation dampening device in an open-loop mode, on the basis of stored maps, as a function of the operating conditions of the engine and/or of the system for variable actuation of the engine valve.

13. The system according to claim 9, wherein the communication of the aforesaid auxiliary chamber with the volume of pressurized fluid is a permanently opened communication.

14. The system according to claim 9, wherein said auxiliary chamber and said movable member are provided within the body of the oscillation dampening member, said body comprising a separate element.

15. The system according to claim 9, wherein said auxiliary chamber and said movable member are provided within the body of said slave piston.

16. The system according to claim 9, wherein said auxiliary chamber and said movable member are provided within the body of said master piston.

17. The system according to claim 9, wherein said auxiliary chamber and said movable member are provided within the body of said electrically operated control valve.

* * * * *